United States Patent [19]

Hongo

[11] Patent Number: 4,660,402

[45] Date of Patent: Apr. 28, 1987

[54] APPARATUS FOR ADJUSTING TOOL LENGTH OF BENDING MACHINE

[75] Inventor: Toshio Hongo, Ichikawa, Japan

[73] Assignee: Maru Kikai Kogyo Co., Ltd., Japan

[21] Appl. No.: 813,550

[22] Filed: Dec. 26, 1985

[30] Foreign Application Priority Data

Dec. 29, 1984 [JP] Japan ..... 59-281519

[51] Int. Cl.[4] ..... B21D 5/02

[52] U.S. Cl. ..... 72/389; 72/319; 72/323; 72/481; 72/446; 72/478

[58] Field of Search ..... 72/320, 321, 319, 413, 72/322, 323, 481, 482, 446, 448, 478, 389; 269/164

[56] References Cited

U.S. PATENT DOCUMENTS

| | | | |
|---|---|---|---|
| 2,302,958 | 11/1942 | Jensen | 72/319 |
| 2,782,831 | 2/1957 | Todd, Jr. | 153/21 |
| 3,147,791 | 9/1964 | Raven et al. | 72/319 |
| 3,359,771 | 12/1967 | Meyerchick | 72/319 |
| 3,495,435 | 2/1970 | Hanni | 72/448 |
| 4,014,204 | 3/1977 | Hanni et al. | 72/413 |
| 4,089,198 | 5/1978 | Annano et al. | 72/478 |
| 4,112,731 | 9/1978 | Anderson et al. | 72/478 |
| 4,532,792 | 8/1985 | Hongo | 72/319 |

FOREIGN PATENT DOCUMENTS

| | | | |
|---|---|---|---|
| 264969 | 12/1965 | Austria . | |
| 2032308 | 5/1980 | United Kingdom | 72/319 |

*Primary Examiner*—Robert L. Spruill

*Assistant Examiner*—David B. Jones

*Attorney, Agent, or Firm*—Andrus, Sceales, Starke & Sawall

[57] ABSTRACT

An apparatus for adjusting the tool length of a bending machine comprises a ram having a lower end, a top tool body mounted on the lower end of the ram, a bottom tool mounted below the top tool body, a top tool including a pair of central dies mounted longitudinally movably on the lower end of the ram, a plurality of upper split dies arranged outside the central dies and mounted reversibly to the upper die row, a plurality of thin upper dies inserted reversibly between the central dies and being thinner than the upper split die, and upper corner dies arranged on both left and right ends of the upper split die, a shift mechanism for sliding the central dies reversely at the central portion of the lower portion of the ram, a drive mechanism for sliding the upper corner dies to the longitudinally symmetrical positions of the lower portion of the ram, shafts pivotably disposed at the back of the central dies and upper corner dies, a plurality of the upper split dies wedged to the shafts and reversed in pivoting of the shaft to be selectively inserted between said central die and upper corner die, a wedge releasing mechanism for releasing the upper split die from the wedge to be received in the corresponding upper die in pivoting the shaft, and a mechanism for selecting the number of the thin upper dies supported by the shaft at the back of the central dies so as to be reversed.

7 Claims, 18 Drawing Figures

APPARATUS FOR ADJUSTING TOOL LENGTH OF BENDING MACHINE

BACKGROUND OF THE INVENTION

1. Field of the Invention

This invention relates to an apparatus for adjusting the tool length of a bending machine in which the effective length of an upper tool can be exchanged to the desired bending length according to the bending width of a sheet metal plate.

2. Description of the Prior Art

Metal plates having each edge of four sides of a rectangular sheet metal bent by at least one or two times are used for cabinets, display cases, bending machines, refrigerators, freezers, air conditioners, computer units, various office machines, etc. To prepare such plates, wiping benders, folding machines or press brakes are used to bend each side edge of a sheet metal previously cut into a quadrilateral. For example, in order to bend each side edge in the U-shaped form, the edge of one short side of the sheet metal is bent by two steps (short side bending) and then, after the sheet metal is turned 180° on a handling table, the edge of the other short side is bent. Next, the sheet metal is turned 90° and the edge of one long side is bent (long side bending) by a clamp die or punch set to the bending width adjusted to the inside of the short side bending. Further, the sheet metal is turned 180° and the other long side is bent so that the rectangular metal plate having the four side bent in the U-shaped form is obtained from the first step bending and the following second step bending.

In the above working, when the long side of the metal is bent, rising portions are produced by bending the previously bent short side, so that the upper die should have the length of the long side obtained by subtracting the thickness corresponding to two sheets and avoid the interference with the rising side of the short side. Thus, a plurality of the upper dies having different die widths are prepared and every time the sheet width is changed, the die is interchanged manually. To overcome the defects caused by such manual operation, an apparatus for adjusting the tool length has been developed in which the upper die can be split while the upper split dies having different die widths are combined such that unnecessary upper dies are retreated or inverted according to the sheet metal length to be adjusted to a desired upper die length. However, since the die length is only stepwise changed by simply putting in and out the upper split dies, it cannot cope with the bending work for various lengths of works, presenting problems of complicating control for changing the die length.

Also, as above mentioned, when the respective side edges of the metal plate are bent in the U-shaped form, since the edges of the short sides are previously bent into the rise having the U-shaped section, the upper corner dies should avoid the interference with this rise to approach the sheet metal. Furthermore, when the die is withdrawn after the U-shaped bending of the long side edge, the upper corner die should not interfere with said rise. Thus, normally, an openable die (or rotary die) is mounted on the upper corner dies disposed on both ends of the upper split dies by the use of a pin. And to pivot this openable die without any troubles, a clearance is provided in an edge portion of the upper corner die body to avoid the contact with the pivotal portion of the openable die. However, since this clearance provides a cut-out portion of the edge line of the upper die, the bending line of the sheet metal has irregularities on the clearance portion so that accurate bending form cannot be obtained.

An object of the present invention is to provide an apparatus for adjusting the tool length of a bending machine in which the tool length can be changed easily and quickly.

A further object of the present invention is to provide an upper bending die in which the edge lines of the lower portion of the upper corner die body and the openable die are interconnected continuously.

SUMMARY OF THE INVENTION

The present invention provides an apparatus for adjusting the tool length of a bending machine which comprises a mechanism for reversing the upper split die and mounted on the rear side of a ram to make the whole apparatus compact without mounting elements for exchanging the tool length in front of a machine and render the exchanging operation accurate. That is, the present invention comprises a groove formed in the lower portion of the ram to mount the upper die, a lower die provided on the upper surface of a front plate, a pair of central dies and a pair of upper corner dies slidably inserted in said groove, a drive mechanism for sliding the upper corner dies to the longitudinal symmetrical positions on the lower portion of the ram, a pivotable shaft disposed on the back of said central and upper corner dies, a plurality of upper split dies wedged to the shaft, reversed when the shaft is pivoted and selectively inserted between said central die and upper corner die, a wedge releasing mechasnism for releasing the upper split die from the wedged condition and putting it in the upper corner die to hold the corresponding upper die under the non-reversing condition in pivoting the shaft, a plurality of thin upper dies supported by the shaft in the back of the central die and reversed in pivoting the shaft to be inserted between the central die and a mechanism for selecting the number of the thin upper dies to be reversed.

In working the present invention, for example, are arranged two central dies having 75 mm thickness, 21 upper split dies having 50 mm width each outside the central die, the upper corner dies having 100 mm width each at the left and right side, and further 10 thin upper dies having 5 mm width at the cenral portion. When all these dies are used, the total tool length reaches 2,500 mm, the maximum length. By leaving the central dies and the upper corner dies as they are and selecting the combination of the segments of left and right upper split dies and thin upper dies to be used can be freely adjusted the tool length between the maximum to the minimum by 100 mm or 5 mm pitch. Further, since the thickness of the sheet metal is normally 1 to 3 mm, the upper die length has each 2.5 mm pitch at both ends, assuming the thin upper die is 5 mm thick, so that the change in the work length within said extent can be substantially coped with. Also, the operation of said drive mechanism, reversing mechanism, etc. permits the bending operation of differently sized sheet metal to be flexibly carried out by employing the NC control.

Also, in the present invention, the upper corner dies at both ends of the upper split die group are improved to make the bending operation of the four sides of sheet metal advantageous. Namely, the upper corner die according to the present invention consists of a main body having same type and openable dies pivotably supported relative to the main body. The upper corner die is provided inside the lower portion with a pin supported link which supports the openable die on the end. A rod erected on the central; portion of the upper surface of the openable die is inserted loosely into a guide hole in said main body. Since the upper split die adjacent the upper corner die and the openable die are formed with continuous edge lines connected closely to each other without providing any clearance between the edge portions, accurate bending can be provided with respect to all bending lines. Further, since the openable dies, after descending vertically along a central rod, are inverted repsectively inside at both end positions of the upper die row by the ascend of the rom, they can be smooth withdrawn from the sheet metal.

The present invention can be applied not only to press brakes, but also to bending machines such as folding machine, wiping bender, etc.

BRIEF DESCRIPTION OF THE DRAWINGS

A preferred embodiment of the invention—illustrative of the bent mode in which applicants have contemplated applying the principles—is set forth in the following description and shown in the drawings and is particularly and distinctly pointed out and set forth in the appended claims.

DESCRIPTION OF PREFERRED EMBODIMENTS

Figure 1:
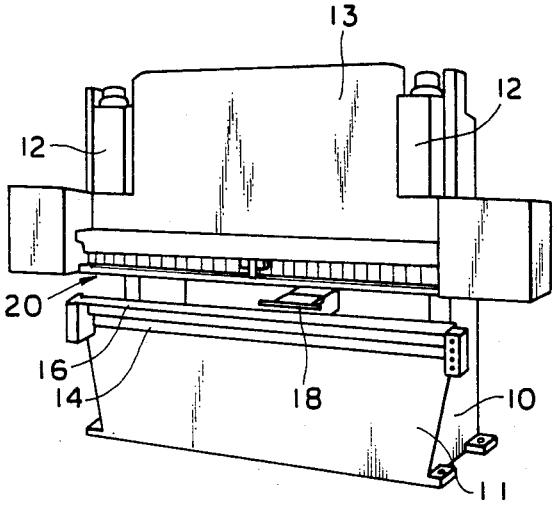
FIG. 1 is a perspective view showing a bending machine provided with an apparatus for adjusting the tool length according to the present invention.

Referring now to the drawings, a preferred embodiment of the present invention is illustrated therein and reference numeral 10 designates left and right frames, 11 is a front plate stretched in front of the frames, 12 press cylinders mounted on the upper ends of the frames, 13 a ram moved vertically to the front plate 11 by the actuation of the press cylinders 12. Reference numeral 14 designates a bed on the upper surface of the front plate, 15 a slide member provided on the bed 14, 16 a lower die, 17 V-shaped groove formed in the lower die 16,18 a back gauge, 19 a T-shaped groove formed in the lower end of the ram and 20 a group of upper dies (punch).

As shown in FIGS. 2 to 5, the group of upper dies 20 are constituted from a pair of left and right central dies 1A,1B slidable longitudinally of the tool length, a pair of left and right upper corner dies 7A,7B slidably similarly, a plurality of upper split dies 2A to 6A and 2B to 6B which are inserted between the central die and the upper corner die and a plurality of thin upper dies 8 which are inserted between the left and right central dies. Said upper split dies and the thin upper dies cannot slide and are supported by the shaft to be reversed rearward and adjusted to the change in the tool length.

Figure 5:
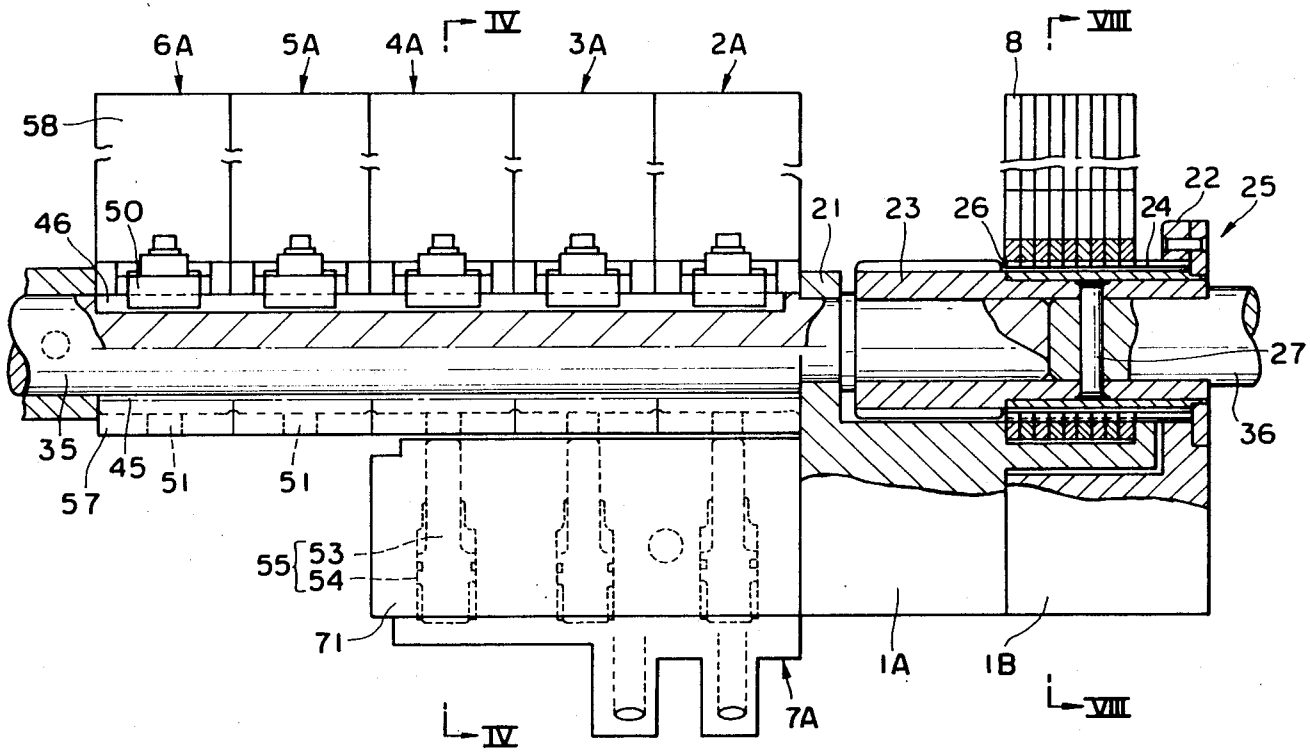
FIG. 5 is a cross-sectional view taken along the line V—V in FIG. 4.
Figure 8:
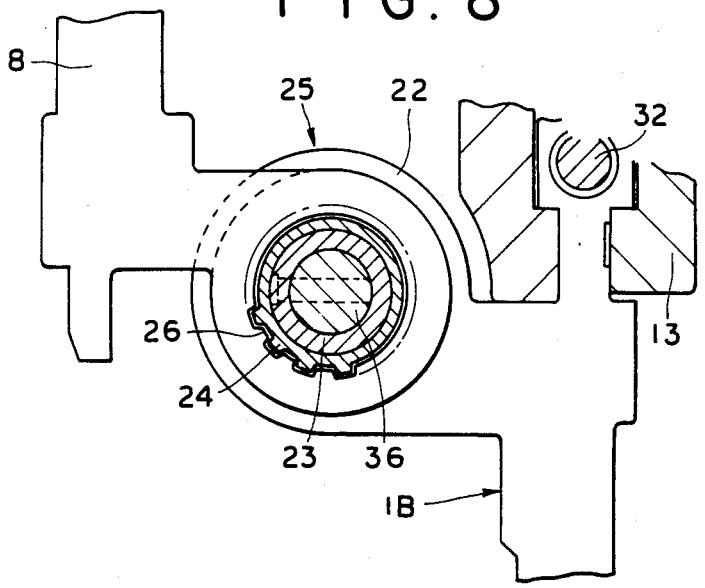
FIG. 8 is a sectional view taken along the line VIII—VIII in FIG. 5.
Figure 7:
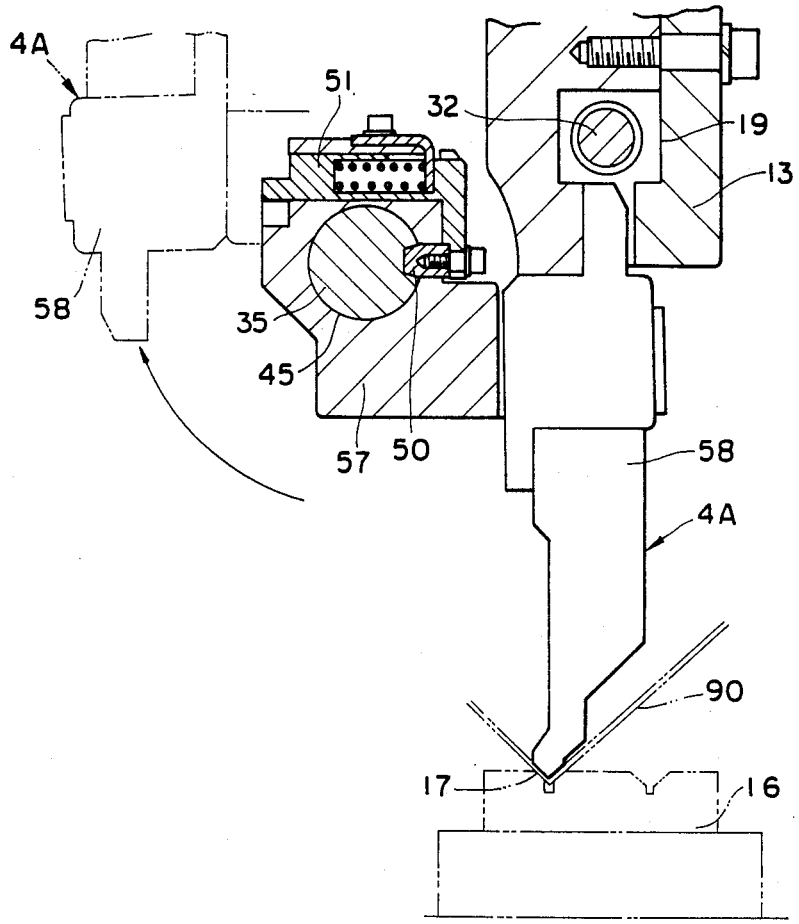
FIG. 7 is a sectional view showing the condition of the upper split die reversed from the condition in FIG. 6.

As shown in FIGS. 5 and 8, the central dies 1A,1B have the upper portion inserted into a groove 19 in the lower end of the ram to be slidably supported thereby. Brackets 21,22 extend to the back of the central dies to hold the thin upper die group 8 and spline cylinder 23,24 having a split respectively, as will be later described. The left and right upper corner dies 7A,7B have the upper portions inserted into the groove 19, while being supported slidably by a drive mechanism 30. That is, the upper corner die is formed in the interior with a female screw 31 in which it is screwed a left and right threaded rod 32 extending through the groove 19 so that the left and right upper corner dies are moved in the opposite directions to each other by driving a rotary unit 33 on the rod end. Further, while the upper corner die has an openable die 72 pivotably connected to the upper corner die body, the constitution and features of the openable die will be described later.

Figure 3:
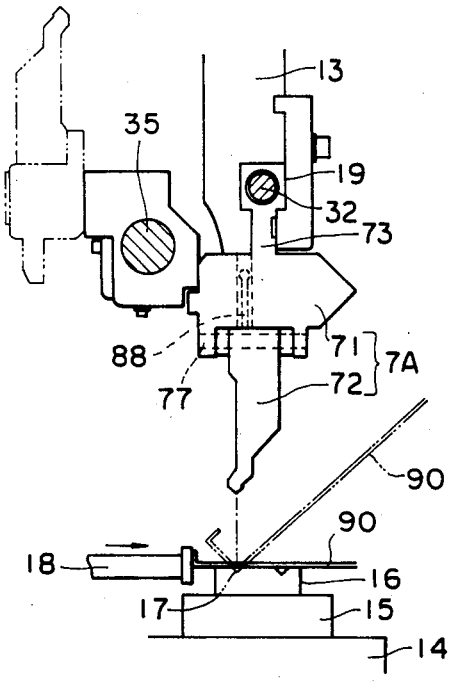
FIG. 3 is a side view showing same in FIG. 2.
Figure 10:
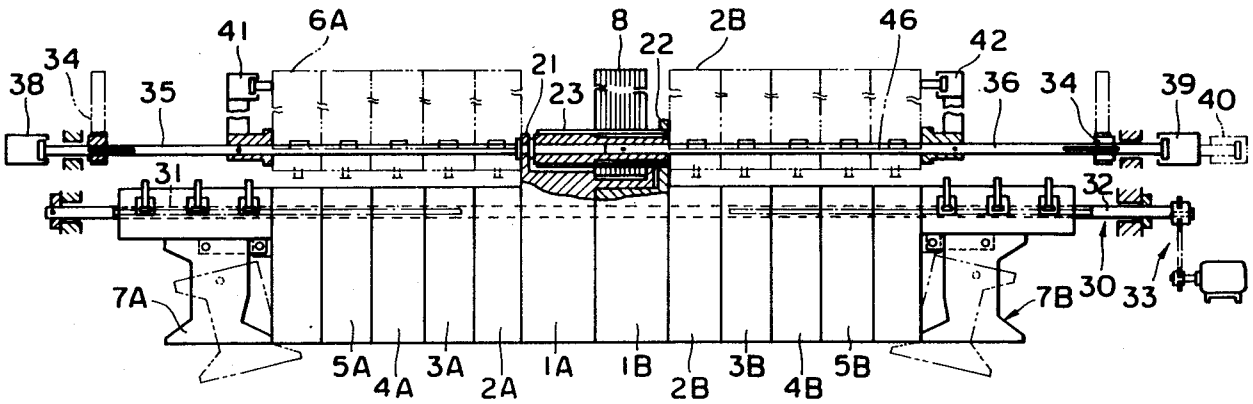
FIGS. 10 to 13 are schematic front views showing an apparatus operated for changing the tool length.

As shown in FIGS. 3 and 10, a pair of left and right shafts 35, 36 are disposed on the back of said central dies 1A,1B and provided near the needs with a reversing drive unit 34 such as rack and pinion or gear mechanism to be supportably rotated 180°. Also, the shaft are provided on the ends with cylinders 38,39 operated when the number of the thin upper dies 8 to be reversed is selected and further on an end of one cylinder with a shift cylinder 40 for centering the whole upper die group when the odd number of the upper split dies are used. Further, on the way of the shafts 35,36 are provided cylinders 41,42 for fastening the upper split die group reversely ascending.

Figure 6:
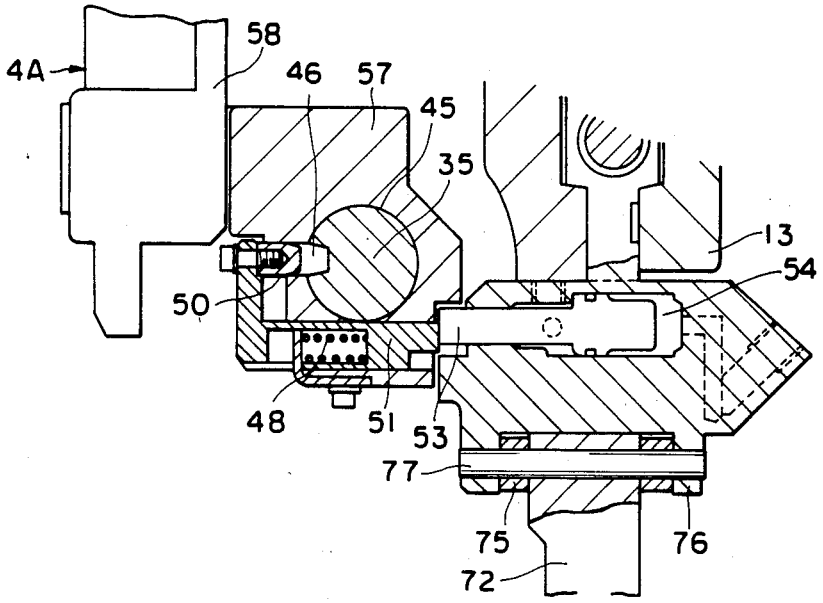
FIG. 6 is a sectional view showing the condition of the upper split die having a wedge removed in FIG. 4.

As shown in FIG. 6, the upper split dies 2A,2B—6A,6B are cnstituted respectively from body portions 57 and die portions 58, and shafts 35,36 are inserted into a hole 45 laterally provided in a body portion 57 and provided with a longitudinal key way 46 on a portion supporting the whole upper split dies (FIGS. 5 and 10). To the lower portion of the body portion 57 is attached a movable body 51 urged normally to advance by a spring 48. A wedge 50 is provided which is bent and inserted into the key way 46 in said shafts 35,36 from the upper end of this movable body 51.

On the other hand, the upper corner dies 7A,7B have the tool length of integral times that of the upper split dies (two times in the drawing) and as shown in FIGS. 5 and 10, the upper portion has further the tool length plus the length of one upper split die (one corresponding to 3 upper split dies in the drawing). In the upper corner dies are provided a wedge releasing mechanism 55 consisting of a piston 53 and a cylinder 54 to release said upper split dies from the wedge and hold said upper split dies under the non-reversing condition in pivoting the shafts 35,36. As shown in FIGS. 5 and 8, the thin upper dies 8 are provided respectively with a spline hole 26 meshing with a spline cylinder and supported on a mechanism 25 for selecting the number of the upper split dies to be reversed. This mechanism 25 consists of spline cylinders 23,24 having splits near the position in which the shafts 35,36 are butted against each other and the cylinders 33,39 for shifting each shaft outward, and one spline cylinder 23 is secured fixedly to an end of one shaft 36 by the use of a pin 27 to reverse the thin upper die 8 engaging the corresponding spline cylinder 23 in rotating the shaft. The other spline cylinder 24 is secured fixedly to the bracket 22 for one central die to support the thin upper die 8 engaging the corresponding spline cylinder 24 under the non-reversing condition.

Now will be detailed the upper corner dies 7A,7B in the present invention.

The upper corner dies are arranged left and right of the upper split die row and moved in the opposite directions to each other by the left and right reversely threaded rod 32. As shown in FIGS. 2,4,5,9 and 10, the upper corner dies 7A,7B consist of main bodies 71 having the height equal about a half of that of adjacent upper split die and openable dies mounted on the lower portion of the main body. The T-shaped portion formed on the upper portion of the main body 71 is inserted into a T-shaped groove 19 in the lower portion of the ram 13 to be screwed onto the screw rod 32 extending through the T-shaped groove 19.

Figure 9:
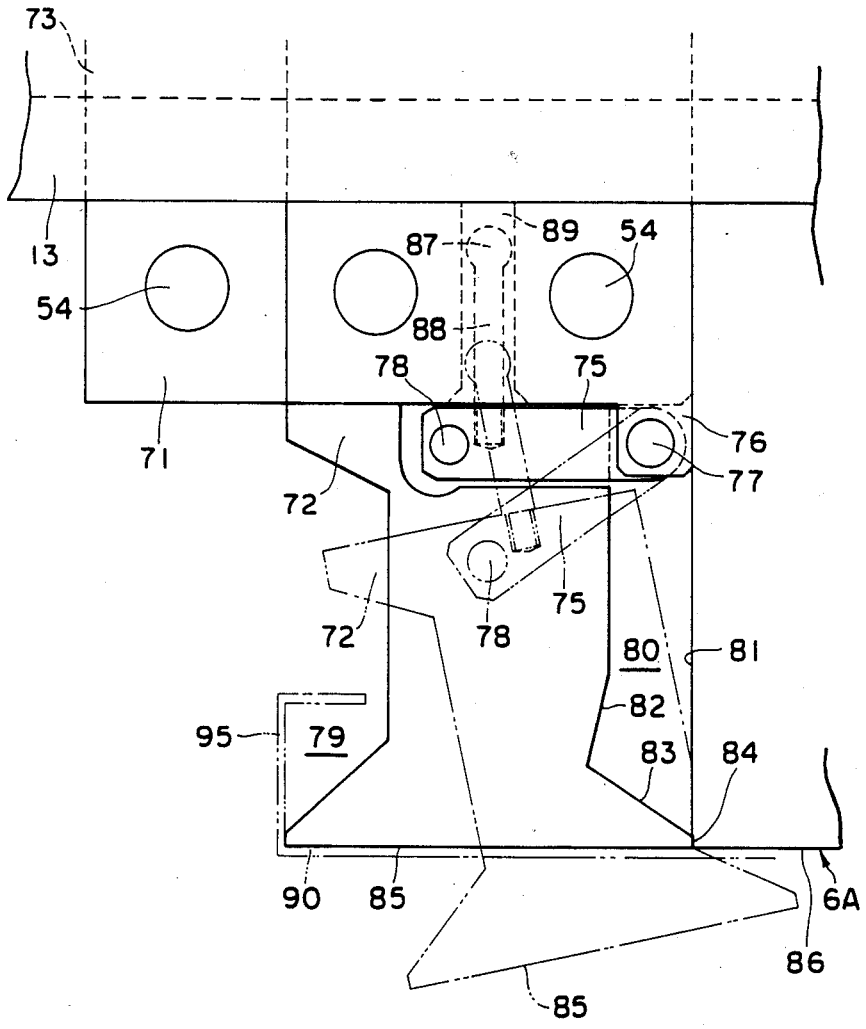
FIG. 9 is a front view showing an upper corner die according to the present invention.

Said openable die 72 is mounted removably on the main body through a link 75 provided on the lower portion of the main body 71. That is, a bracket 76 is suspended from the lower corner of the main body 71 at the side contacting the upper split die, and a pin 77 extends through this bracket 76 in the direction orthogonal to the bending line to mount said link 75, on the end of which is supported the openable die 72 by the use of a pin 78. As shown in FIG. 9, the openable die 72 has a recess 79 to avoid the interference with a rise 95 at the work end side as viewed from the front and is formed with a cavity 80 at the side adjacent the upper split die. The cavity 80 has a side oblique surface 82 abutting against an end face 81 of the adjacent upper split die in withdrawing the dies to prevent the upper split die from further pivoting. Furthermore, a side oblique surface 83 extending from the lower end of the side oblique surface 82 toward the edge of said upper die is provided to form a vertical flat surface 84 contacting closely to said end face 81 of the upper split die in the lower end of the side oblique surface. When the openable die contacts closely the upper split die, any clearances are not produced between edges 85,86 of both dies by the presence of the flat surface 84 to hold a continuous edge line at the same level. Further, a rod 88 with a head 87 is planted into the upper surface of the openable die 72. A guide hole 89 corresponding to the rod 88 is provided in the main body 71. When the openable die 71 begins to be opened, the rod 88 descends vertically through the guide hole 89 before the link pivots about the fulcrum, and after said flat surface 84 is spaced from the adjacent upper split die, the link is allowed to pivot about the fulcrum and brought down to the position shown by the chain line in FIG. 9.

Next will be described the operation of said apparatus with reference to FIGS. 10 to 13.

Figure 17:
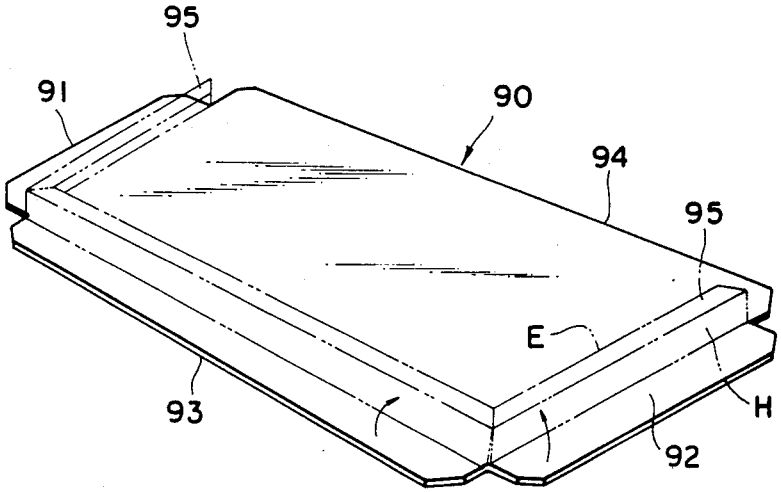
FIG. 17 is a perspective view showing a sheet metal.
Figure 18:
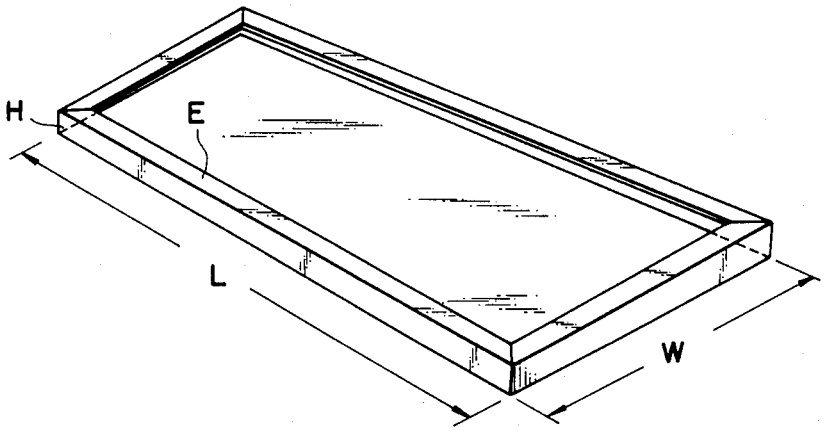
FIG. 18 is a perspective view showing a finished bent product.

Four side edges of a sheet metal 90 which is cut previously into an approximately rectangular shape as shown in FIG. 17 are bent into the U-shaped form as follows; First, the edge of one short side 91 is bent in two steps into the U-shaped form and then the work is turned 180° in a plane on a handling table (not shown). The other short side 92 of the metal is thus bent similarly. In the bending of these short sides, the adjustment of tool length is not needed and the length of the upper die larger than that of the short side will do. Next, the work is turned 90° and the edge of one long side 93 is bent. The work is further the turned 180°, and other long side is bent. As a result, as shown in FIG. 18, a product of rectangular shape having a width W and a length L with the four sides bent in a U shape by the first bends E and the second bends H, is obtained. In the above working, since the U-shaped rise 95 is produced by bending the short said edge, the length of the upper die should be adjusted in bending the long side. Also, the upper corner dies 7A,7B should avoid the interference with the rise 95 in approaching the work and in withdrawing the dies after bending the long sides. The present invention can cope with all these requirements.

Now, to simplify the description, the present invention will be described with reference to the change of work length (length of long side) corresponding to two central dies having 75 mm width, 5×2 upper split dies having 50 mm width, 2 upper corner dies having 100 mm width and 10 thin upper dies having 5 mm width.

Figure 11:
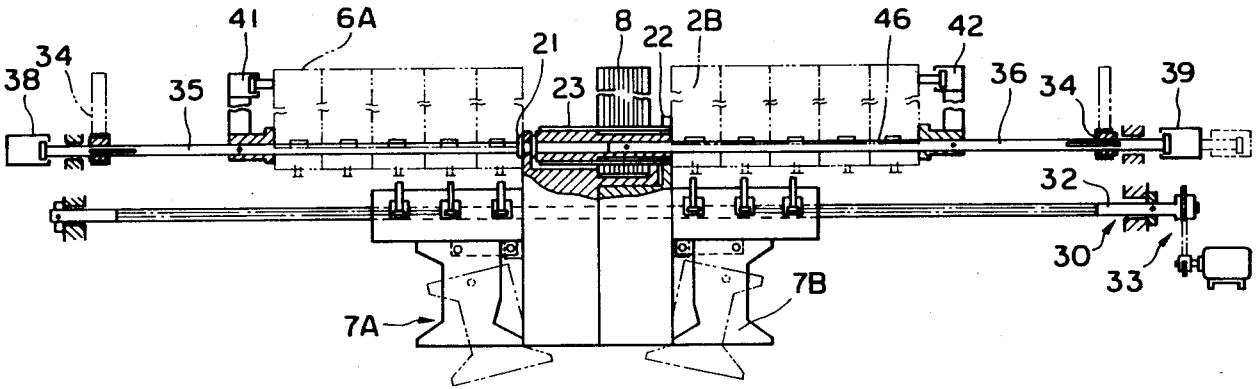

FIG. 10 shows the tool length of 850 mm using all dies except for the thin upper dies 8, and FIG. 11 shows the tool length of 350 mm with the central and upper corner dies.

Figure 12:
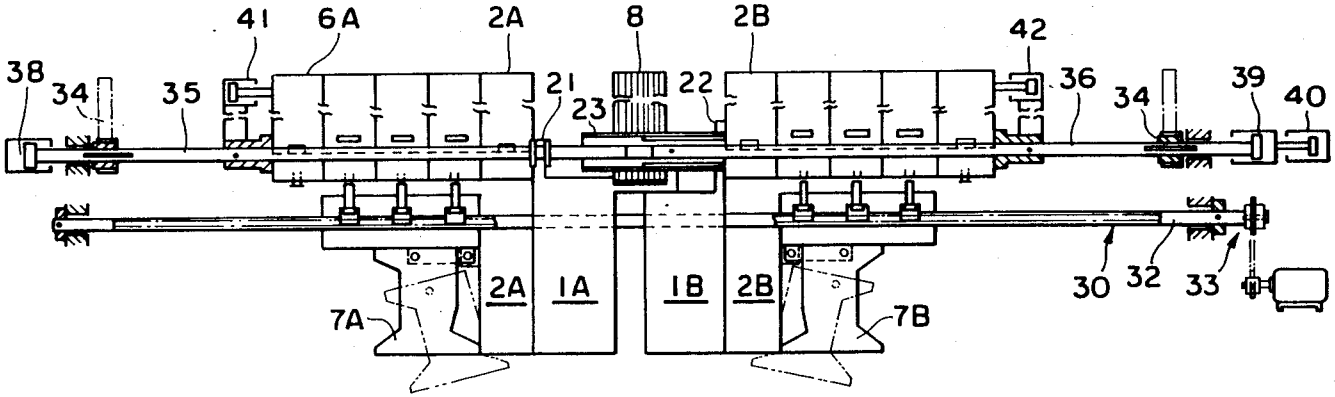
Figure 13:
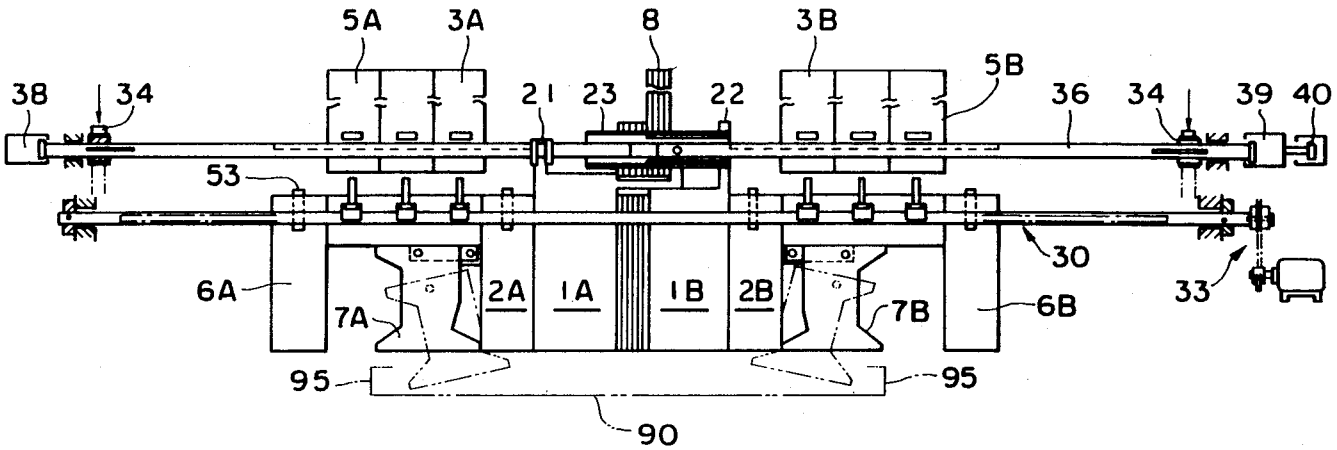

Now will be described the case in which 350 mm tool length shown in FIG. 11 is changed for 475 mm one. First, the rotary unit 33 is driven by an NC control to rotate the screw rod 30 and move left and right the central dies 1A,1B each by 150 mm. By this movement is moved the piston 53 of the wedge releasing mechanism for the upper corner dies 7A,7B to the position of each movable body 51 of wedge for the upper split dies 3A to 5A, 3B to 5B. Here, the cylinder 54 is operated to move left the movable body 51 and remove the wedge 50 at the upper end from the key way 46 by the extension of the piston 53 as shown in FIG. 6. When under this condition the shafts 35,36 are withdrawn each 12.5 mm left and right by the cylinder 38,39, the central dies 1A,1B are moved away from each other by the same dimension as shown in FIG. 12. Then, when the reversing drive unit 34 is driven to pivot the shafts 35,36, five thin upper dies 8 are inserted into the 25 mm gap between the central dies 1A,1B. At the same time, the upper split dies 2A,2B and 6A,6B other than those turned off by the releasing mechanism 55 are rotated 180° so that the 475 mm tool length can be set as shown in FIG. 13.

Thereafter, the ram 13 is lowered to bend the proximity of edge of the sheet metal 90 and bend the long and short sides for providing a completed product as shown in FIG. 18. After the completion of bending, when the tool length is again changed, the reversing drive unit 34 is driven in the opposite direction to the previous one to reverse simultaneously five thin upper dies 8 inserted between the central dies 1A,1B and the upper split dies 2A,2B left wedged in the shafts 35,36 to the condition shown in FIG. 12. Next, after the rotary unit 3 is reversely rotated and the left and right threaded screw rod 30 is rotated to return the upper corner dies 7A,7B to the original positions, the piston 53 is retreated to insert the wedges 50 of all upper split dies into the key way 46 and reverse the shafts 35,36 for returning them to the condition shown in FIG. 10.

Figure 2:
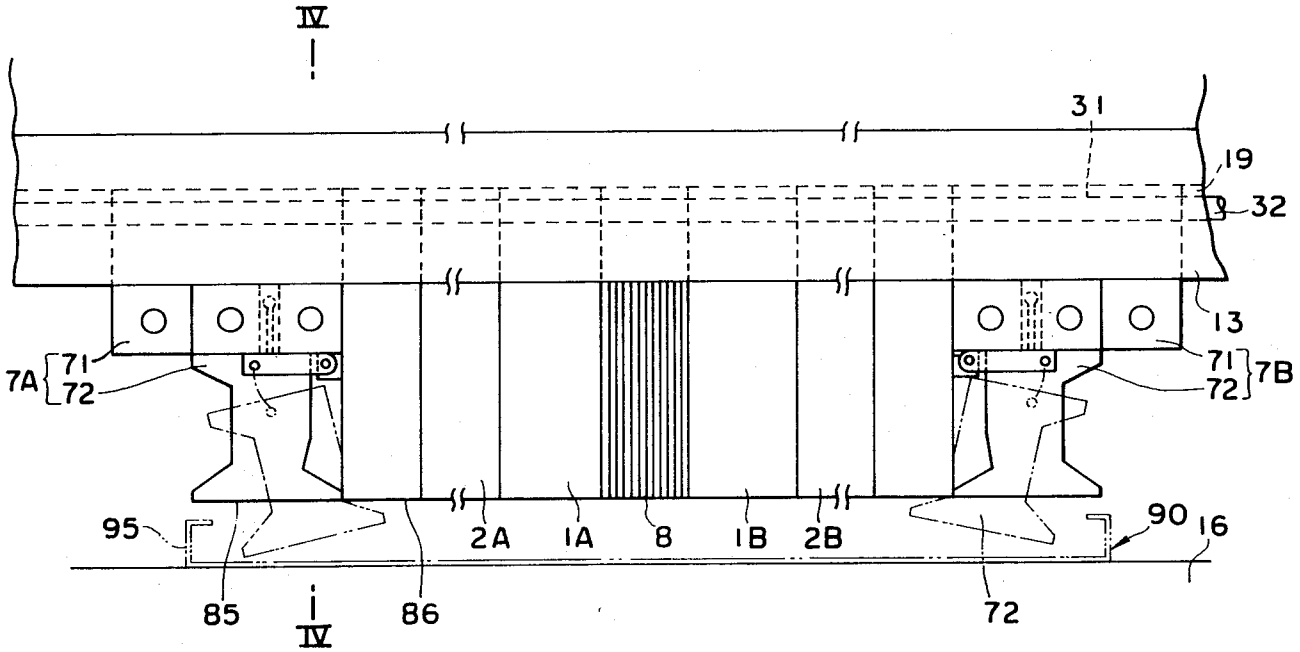
FIG. 2 is an enlarged front view showing the upper die portion in FIG. 1.
Figure 4:
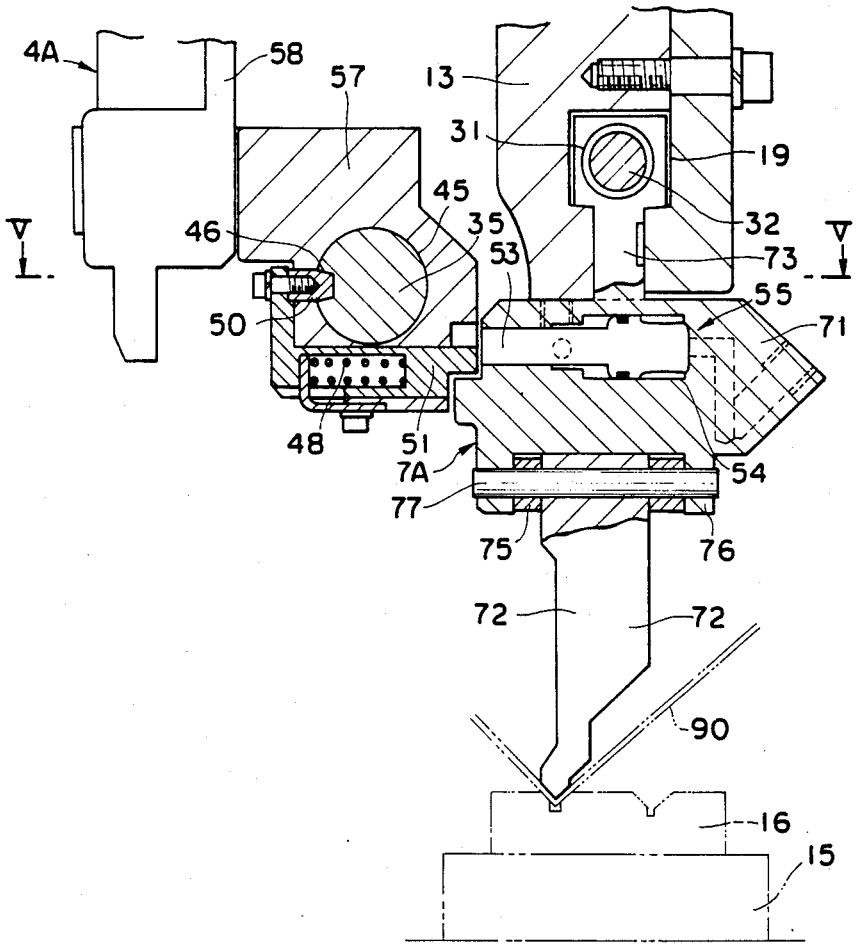
FIG. 4 is an enlarged sectional view taken along the line VI—VI in FIG. 2.

The upper corner dies 7A,7B before and after the bending are operated as follows;

As shown in FIGS. 2 and 9, until the openable die 72 of the upper corner die descends from the ram lifting position and touches the sheet metal 90, it is supported and brought down inward slantly by the link 75 as shown by the chain line in said drawings. When the ram 13 is lowered as it is, it does not abut against the rise 95 of sheet metal. When the ram 13 is further lowered, the openable die 72 touches the work before the upper split dies 2A,2B—6A,6B touch same and begins to pivot clockwise in FIG. 9. Then, when the edges 86 of upper split die touch the work, as shown by the solid line in the same drawing, the flat surface 84 of the openable die contact closely the end face 81 of the adjacent upper split die 6A or 6B, while the edges 85,86 are arranged on the same line. Since the edge line does not have any gaps, it can withstand a large load so that the sheet metal can be bent along a clear even bending line by pressing it under such condition.

After the completion of bending, when the ram 13 is raised, while the openable die 75 hung by the link 75 tends to pivot about the pin 77 with its own weight, the rod 88 guided by the hole 89 is regulated to descend for example 3 to 5 mm vertically at the beginning of the pivoting. Since the flat surface 84 of the openable die is moved out of the end face 81 by that vertical descend, the openable die is thereafter pivoted about the pin 77 and the side oblique surface 82 abuts against the end face of the upper split die and stops so that it can return to the condition shown by the chain line and be withdrawn without interfering with the rise 95 of the work.

Figure 14:
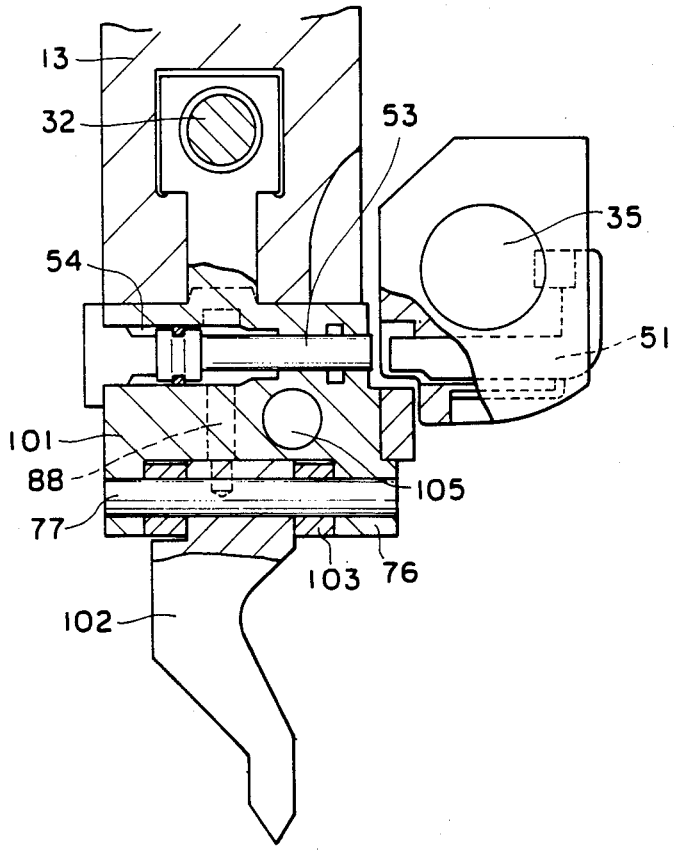
FIG. 14 is a sectional view of an embodiment of the present invention applied to a goose-neck-shaped press brake.
Figure 15:
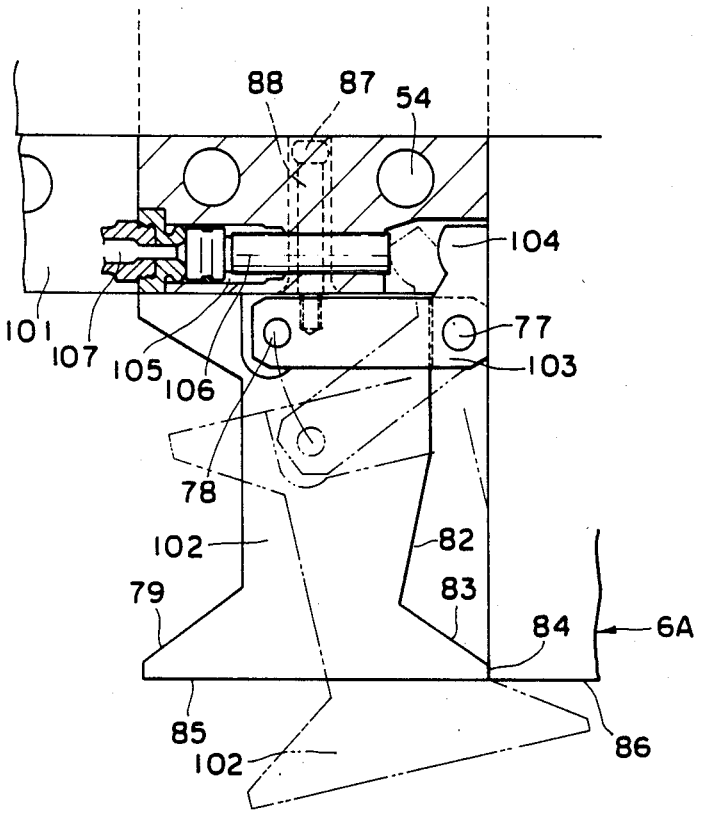
FIG. 15 is a front view showing the upper corner die of the apparatus shown in FIG. 14.

FIGS. 14 and 15 are sectional and front views showing a modification of the upper corner die. In this example, applied to the goose-neck-shaped press brake, same parts as those in FIG. 9 are designated by the same symbols. As shown in FIGS. 14 and 15, a main body 101 is provided on the lower corner with the bracket 76 for supporting the goose-neck-shaped openable die 102 through a link 103. An arm 104 is provided upward from the pivotal fulcrum side of the link 103, while an air cylinder 105 parallel to the edge line is provided in the main body 101 and an end of a piston 106 inserted into the cylinder 105 is disposed to abut against an end of said arm 104. Before entering the bending process, pressurized air is supplied from an approach port 107 of the cylinder to move the piston 106 right, hold the link 103 horizontally and make the openable die 102 contact closely the main body 101 and the upper split die. Before and after the bending process, air in the cylinder 105 is vented to slant the openable die 102 by its own weight and avoid the interference with the rise 95 of the sheet metal similarly to the previously mentioned embodiment. Also, similarly, the edge line is formed without any gaps between the openable die and adjacent upper split dies.

Figure 16:
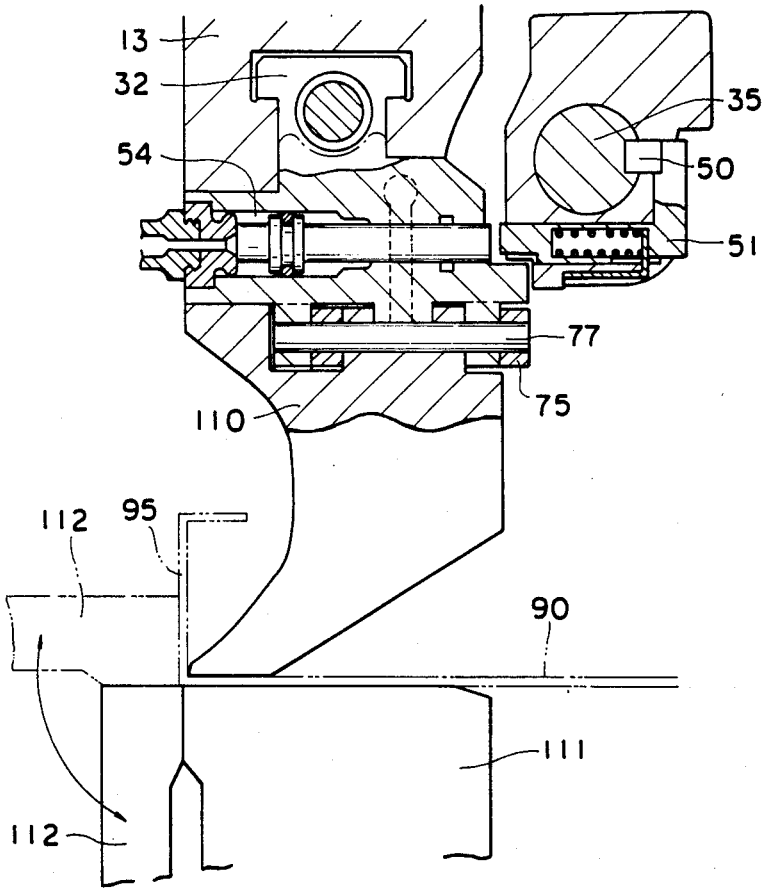
FIG. 16 is a sectional view showing an embodiment of the present invention applied to a folding machine.

FIG. 16 shows a further modification of the upper corner die applied to a folding machine according to the present invention. This upper corner die is almost same as that in FIGS. 14 and 15. The die itself applies to a clamp die 110 of the folding machine which is opposed to a lower die 111 and lowered by the press cylinder of the ram to clamp the sheet metal 90 and bend the sheet metal edge by pivoting a rotary die 112 in the direction of arrow. In this case, while all of the upper split die, central die and thin upper die have the same shape as the clamp die 110, the illustration of them is omitted. The operational effect of the upper corner die is same as that of previously mentioned embodiment.

As above mentioned, since the apparatus for adjusting the tool length of a bending machine according to the present invention has the reversible upper split dies together with the reversible thin upper dies for fine adjustment of the tool length, it can sufficiently cope with the change of the sheet metal length and easily accurately carry out the working to bend four sides.

What is claimed is:

1. An apparatus for adjusting the tool length of a bending machine comprising:

a support means, a ram mounted to said support means and having a lower end;

a top tool mounted on the lower end of said ram;

said top tool including a pair of central dies slidably mounted and longitudinally movably on the lower end of the ram and having a plurality of upper split dies located in an upper die row in spaced relation from alignment with said central dies, means mounting said upper split dies for selective positioning from said upper die row into alignment with said central dies, a plurality of thin upper dies located in said upper die row in spaced relation from alignment with said central dies and movable from said upper die row into alignment between said pair of central dies and being thinner than said upper split dies, and upper corner dies slidably mounted to said ram, said corner dies being located one each on the opposite ends of said central dies, a shaft mechanism secured to said ram and coupled to said central dies for sliding movement of said central dies along the lower portion of the ram;

a drive mechanism coupled to said upper corner dies for sliding the upper corner dies to longitudinally symmetrical positions to the opposite sides of said central dies;

shaft means pivotably mounted to the back of said central dies and upper corner dies;

a wedge means releasably securing a plurality of said upper split dies to the shaft means for pivoting by said shaft means and thereby selectively inserted between said central dies and upper corner dies;

a releasing means coupled to said wedge means for selectively releasing each of said upper split dies from said shaft means;

a means selectively coupling said thin upper dies to said shaft means for selecting the number of said thin upper dies secured to the shaft means and moved between said central dies.

2. The apparatus for adjusting the tool length of a bending machine according to claim 1, wherein said ram has a groove in the lower portion of the ram and said central dies are slidably fitted into said groove, brackets secured to the back of said central dies, a spline cylinder in said brackets, and said thin upper dies secured to said spline cylinder, and means coupling said spline cylinder to said shaft means.

3. The apparatus for adjusting the tool length of a bending machine according to claim 1, wherein said ram includes a groove in the lower portion of the ram, and said drive mechanism for said upper corner dies comprises a rod having a left threaded portion and right threaded portion and being located in said groove in the lower portion of the ram, female screw means are secured in the upper corner dies and threaded on said rod, and a rotary unit is coupled to one end of the rod.

4. The apparatus for adjusting the tool length of a bending machine according to claim 1, wherein each upper corner die has a width equal to an integral times the width of each of the upper split dies, said releasing means being mounted with said upper die row and including a plurality of sets of cylinder and piston operable to selectively temporarily release each upper split die from the wedge means.

5. The apparatus for adjusting the tool length of a bending machine according to claim 1, wherein said shaft means is divided into first and second aligned shafts having abutting ends and said means for selecting the number of the thin upper dies coupled to said shaft means comprises first and second spline cylinders on said shafts and having adjacent cylinder ends generally aligned with the abutting ends of said shafts and means for shifting each shaft outward, said first spline cylinder being secured fixedly to an end of said first shaft, means to selectively couple said thin upper dies to said first and second cylinder, said first cylinder rotating with said first shaft to move the thin upper die engaging said first spline cylinder with the pivoting of the shaft, and said second spline cylinder being secured fixedly to one central die to selectively support the thin upper die engaging the second spline cylinder in spaced relation to said central dies.

6. A bending machine having upper corner dies arranged in spaced aligned relation to the opposite sides of an upper split die means for changing the upper dies length, comprising a die support, upper corner dies means spaced from each other to the opposite sides of said die means, each corner die means including a main body secured to the die support and a movable die, a link secured to said main body of the upper corner die means and to said die, said main body having a guide opening aligned with said movable die, and a rod coupled to the upper surface of the die and located in said guide hole in the main body of said upper corner die means.

7. The bending machine as define in claim 6, wherein said movable die is rotatably mounted, said die being formed with a cavity for avoiding the interference with said split die means, and said cavity hatably mounted, said die being formed with a cavity for avoiding the interference with said split die means, and said cavity having a lower portion including a flat surface for contacting said upper split die means and forming a continuous edge line.

* * * * *